US012066198B2

(12) United States Patent
Angelopoulos et al.

(10) Patent No.: US 12,066,198 B2
(45) Date of Patent: Aug. 20, 2024

(54) CONTROL FOR A PASSIVE-VENTILATION SYSTEM OF A BUILDING

(71) Applicant: Mitsubishi Electric Corporation, Tokyo (JP)

(72) Inventors: Charalampos Angelopoulos, Livingston (GB); Daniel Coakley, Livingston (GB)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 27 days.

(21) Appl. No.: 17/691,121

(22) Filed: Mar. 10, 2022

(65) Prior Publication Data

US 2022/0316729 A1 Oct. 6, 2022

(30) Foreign Application Priority Data

Mar. 24, 2021 (EP) ..... 21164628

(51) Int. Cl.
*F24F 11/00* (2018.01)
*F24F 11/74* (2018.01)
(Continued)

(52) U.S. Cl.
CPC ..... *F24F 11/0001* (2013.01); *F24F 11/74* (2018.01); *F24F 2110/12* (2018.01); *F24F 2110/30* (2018.01); *F24F 2120/10* (2018.01)

(58) Field of Classification Search
CPC .... F24F 11/0001; F24F 11/74; F24F 2120/10; F24F 2110/12; F24F 2110/30
(Continued)

(56) References Cited

U.S. PATENT DOCUMENTS 4,182,487 A 1/1980 Eriksson
5,626,288 A * 5/1997 Huber ..... F24F 11/88 165/248
(Continued)

FOREIGN PATENT DOCUMENTS

EP 3578893 A1 12/2019
JP 2017-180960 A 10/2017
WO 2013/107461 A1 7/2013

OTHER PUBLICATIONS

Wang et al., "A Semi-Empirical Model for Studying the Impact of Thermal Mass and Cost-return Analysis on Mixed-mode Ventilation in Office Buildings", Energy and Buildings, vol. 67, 2013, pp. 267-274.
(Continued)

*Primary Examiner* — Avinash A Savani
*Assistant Examiner* — Dana K Tighe
(74) *Attorney, Agent, or Firm* — XSENSUS LLP

(57) ABSTRACT

The invention relates to a method for controlling a passive-ventilation system of a building, comprising: determining an outdoor air temperature of air in an environment of the building; determining an indoor air temperature of at least one zone inside the building; calculating a temperature difference by subtracting the determined outside air temperature from the determined indoor air temperature; and, if the calculated temperature difference is greater than zero, controlling a state of at least one passive-ventilation device of the passive-ventilation system to be in any of a closed state, an open state, and one of one or more intermediate states between closed and open state. Each of the states corresponds to one value of an opening fraction value of the at least one zone inside the building varying between 0 and 1.

15 Claims, 1 Drawing Sheet

(51) Int. Cl.
*F24F 110/12* (2018.01)
*F24F 110/30* (2018.01)
*F24F 120/10* (2018.01)

(58) Field of Classification Search
USPC ..... 454/369
See application file for complete search history.

(56) References Cited

U.S. PATENT DOCUMENTS

| | | | | |
|---|---|---|---|---|
| 6,699,120 | B1 | 3/2004 | Darum | |
| 10,295,209 | B2 * | 5/2019 | Yabunouchi | F24F 11/0001 |
| 11,066,865 | B2 * | 7/2021 | Hall | E05F 15/77 |
| 11,231,192 | B1 * | 1/2022 | Shah | F24F 11/0001 |
| 2009/0013703 | A1 * | 1/2009 | Werner | F24F 5/0046 62/180 |
| 2012/0190292 | A1 * | 7/2012 | Skrepcinski | F24F 7/003 454/258 |
| 2019/0331355 | A1 | 10/2019 | Daniels, II et al. | |

OTHER PUBLICATIONS

Ezzeldin et al., "The Potential for Mixed-Mode Office Buildings in Arid Climates", Energy and Buildings, vol. 65, Oct. 2013, pp. 368-381.

Babich et al., "A New Methodological Approach for Estimating Energy Savings Due to Air Movement in Mixed Mode Buildings", Proceedings of Building Simulation Applications 2017: 3rd IBPSA-Italy Conference, 2017, 8 pages.

Sun et al., "A Simulation Approach to Estimate Energy Savings Potential of Occupant Behavior Measures", Energy and Buildings, vol. 136, 2017, pp. 43-62.

Extended European Search Report, EP 21 16 4628.6, dated Sep. 8, 2021, 10 pages.

Office Action issued on Mar. 1, 2024, in corresponding Chinese patent Application No. 202210274227.X, 13 pages.

* cited by examiner

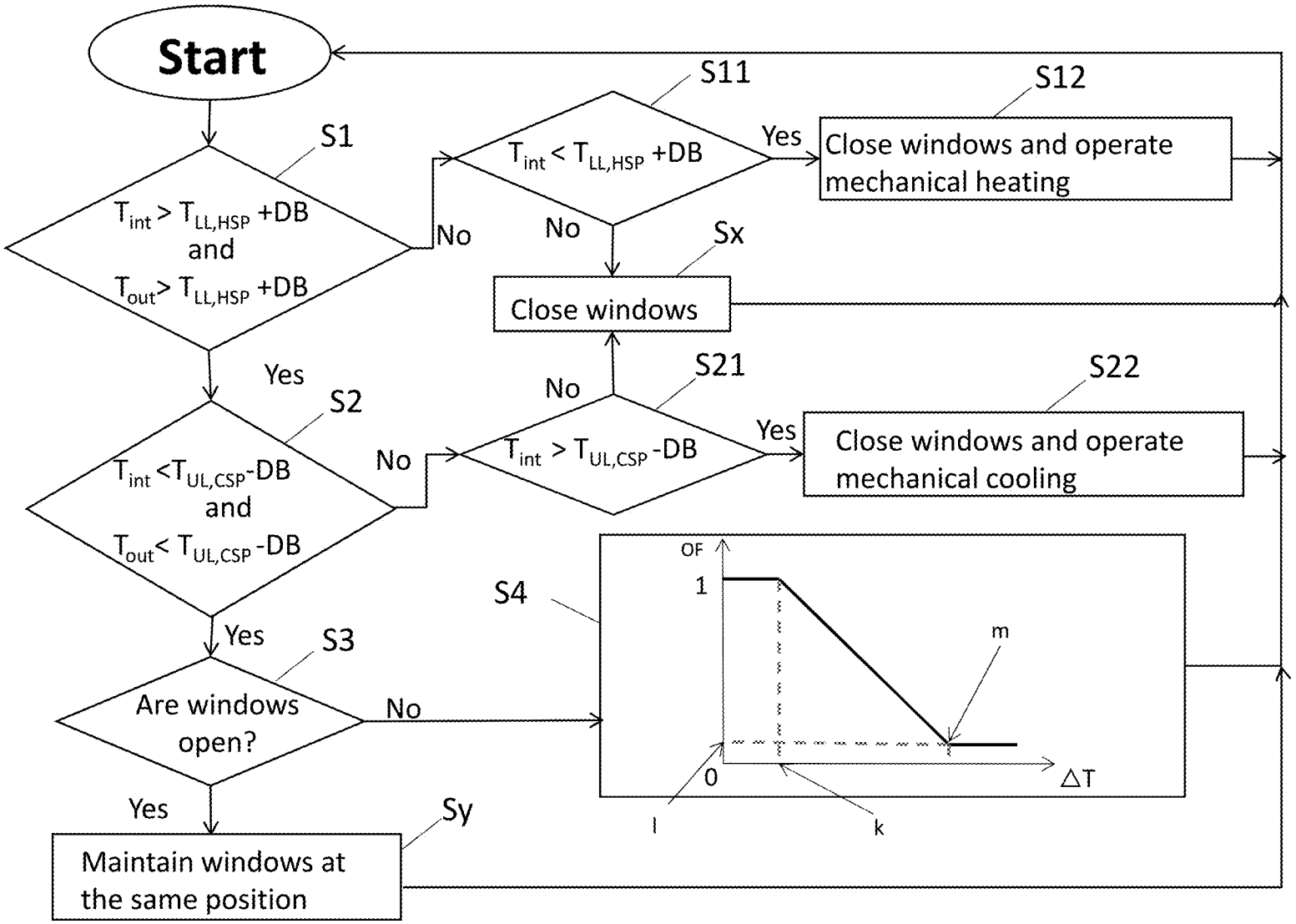
Start
S1
$T_{int} > T_{LL,HSP}$ +DB and $T_{out} > T_{LL,HSP}$ +DB
Yes
No
S2
$T_{int} < T_{UL,CSP}$-DB and $T_{out} < T_{UL,CSP}$-DB
Yes
No
S3
Are windows open?
Yes
No
Sy
Maintain windows at the same position
S11
$T_{int} < T_{LL,HSP}$ +DB
Yes
No
S12
Close windows and operate mechanical heating
Sx
Close windows
S21
$T_{int} > T_{UL,CSP}$-DB
Yes
No
S22
Close windows and operate mechanical cooling
S4
OF
1
0
m
k
l
ΔT

CONTROL FOR A PASSIVE-VENTILATION SYSTEM OF A BUILDING

CROSS-REFERENCE TO RELATED APPLICATION

The present application claims priority to European Patent Application No. 21164628.6, filed Mar. 24, 2021, the entire contents of which are incorporated herein by reference.

DESCRIPTION

The invention relates to controlling a passive-ventilation system of a building.

Controlling the ventilation of a building is an important field of research, in particular regarding the "passive" or "natural" ventilation in buildings. For instance, WO 2013/107461 A1 proposes a method and a system for controlling ventilation of an indoor area of a building, with the ventilating the indoor area by means of active mechanical ventilation and a passive natural ventilation according to a ventilation mode selected among a plurality of ventilation modes, with a set of adjustable control parameters and at least one measurement value from a sensor. Therein, each ventilation mode is associated with the set of adjustable control parameters, each having an adjustable value selected among a group of mode-dependent adjustable values, and/or a set of fixed control parameters each having a mode-dependent fixed value. Controlling the mechanical ventilation and the natural ventilation is achieved by comparing the measurement value from the sensor with a corresponding value of the control parameters of the ventilation mode such that a desired indoor climate defined by the ventilation mode is obtained.

Another passive-ventilation control system is disclosed in US 2019/331355 A1, where respective vents are arranged in multiple sets, with each set of vents being substantially vertically aligned through multiple floors or the entire height of the building.

U.S. Pat. No. 6,699,120 B1 discloses another computer-controlled method of controlling internal climate comfort by natural ventilation in a living room of a building occupied by human users.

U.S. Pat. No. 4,182,487 A proposes to control a venting duct outlet using a simple mechanical apparatus which senses the outdoor temperature, as well as a wind force. This method automatically controls the air exchange to eliminate cold air entering the building.

Further general background relating to natural or passive ventilation is described in EP 3 578 893 A1 and JP 2017 180 960 A.

A study of H. Wang and Q. Chen "A semi-empirical model for studying the impact of thermal mass and cost-return analysis on mixed-mode ventilation in office buildings", published in "Energy and Buildings 67" (2013) 267-274, examined the effects of different windows operation on the energy-saving potential for a mixed-mode office building. The operation of the windows was based on pre-defined positions of the windows, which resulted in estimated savings in the electricity consumption, therein from 10% to 72%, based on the climate and the window opening. The energy-saving potentials of mixed-mode buildings has also been discussed in other studies such as the article "The potential for office buildings with mixed-mode ventilation and low energy cooling systems in aired climates" by S. Ezzeldin and S. J. Rees in "Energy and Buildings" 65, (2013) 368 to 381, and the article "A new methodological approach for estimated energy savings due to air movement in mixed-mode buildings" by F. Babich et al. in "Proceedings of Buildings Simulation Applications" 2007: Third IBPSA-Italy conference, Bolzano 2017.

So, in recent years, the interest in controlling natural or passive-ventilation to achieve thermally comfortable internal environments is increased. The control of natural or passive-ventilation is done by adjusting the opening of corresponding passive-ventilation devices in the facade of the respective building. Such openable passive-ventilation devices may be windows, dampers, grids, vents, and alike.

This leads to the objective technical problem to be solved of how to increase energy efficiency in the ventilation of a building while maintaining a thermal comfortable internal environment.

This objective technical problem is solved by the subject matter of the independent claims. Advantageous embodiments are apparent from the dependent claims, the description, and the FIGURE.

One aspect relates to a method for controlling a passive-ventilation system of a building, which may also be referred to as natural-ventilation system. Said method comprises the method steps of determining an outdoor air temperature of an air in an environment of a building and determining an indoor air temperature of at least one zone, that is, one or several zones inside the building. Said zones may be referred to as thermal zones. Room, halls, corridors, or staircases of the building may be considered as exemplary thermal zones. The respective temperatures may be determined by measurements of temperature sensors of the passive-ventilation system, or determined by accessing a corresponding data base, for instance temperature data of the environment of the building available in the internet. Outdoor and/or indoor air temperature may be determined as averaged air temperatures. If the method is applied to several thermal zones inside the building, an internal air temperature, in particular an average internal air temperature, for each zone may be used to control the passive-ventilation devices of the respective zones. In case of several thermal zones the controlling the states of the passive-ventilation devices may be performed individually, i.e. the states of the passive-ventilation devices may be controlled independently from each other.

By subtracting the determined outside air temperature from the determined indoor temperature, a temperature difference is calculated. If said calculated temperature difference is greater than zero, preferably in combination with the outside air temperature being greater than a given ventilation setpoint, a state of at least one passive-ventilation device of the passive-ventilation system which is associated with one or several or all of said at least one zone inside the building is controlled to be in any of a closed state, an open state, or one of one or more intermediate states between the closed and the open state. Therein, each of the states corresponds to one value of an opening fraction value of the respective at least one zone inside the building which varies between zero and one. Zero corresponds to the closed state, and one to the open state. The respective passive-ventilation device being associated with the respective thermal zone means that it is configured for a fluidic coupling of the corresponding zone or zones inside the building with the environment of the building. So, to each zone to be ventilated passively, one or more passive-ventilation devices may be associated. The intermediate states may, for instance, relate to a 25% open state, 50% open state, and 75% open state to realize gradual opening control.

The state of the corresponding at least passive-ventilation device is then controlled via setting the opening fraction value, the opening fraction value being set to an upper fraction limit=1, if the calculated temperature difference ΔT is equal to or below a preset lower temperature difference limit k, set to a lower fraction limit l equal to or greater than zero and less than 1, if the calculated temperature difference ΔT is equal or above a preset upper temperature difference limit m, and set to a value of a passive-ventilation function of the calculated temperature difference f(ΔT) otherwise, i.e. if k≤ΔT≤m. The passive-ventilation function monotonically decreases with increasing calculated temperature difference.

If the calculated temperature difference is not greater than zero (and/or the given ventilation setpoint), the state of the controlled passive-ventilation device or devices may be left unchanged or, alternatively, be set to an open or closed state.

This gives the advantage of a controlled operation of the passive-ventilation systems which results in thermally comfortably internal environment for the occupants, which relies less on active mechanical systems and thus serves to decrease energy consumption. The use of the predefined states or positions of the respective passive-ventilation devices with the calculated temperature difference results both in a simple and dynamic control scheme, that is, a simple and reliable methodology to control the opening of the passive-ventilation devices for given indoor and outdoor environmental conditions. Determining, for instance measuring, the indoor air temperature of the corresponding zones inside the building repeatedly, that is, dynamically, leads to a simple implementation of a feedback loop which adapts the passive-ventilation system to the situation at hand and thus reduces the use of energy. The additional condition that outside air temperature is greater than the lower limit of the given or pre-set ventilation setpoint ($T_{LL,HSP}$) ensures there is a thermodynamic advantage for ventilation.

In an advantageous embodiment, the state of the at least one passive-ventilation device is only controlled via setting the opening fraction value as described above if both determined outdoor air temperature and determined indoor air temperature lie in a range between a lower setpoint, a heating setpoint and an upper setpoint, a cooling setpoint $T_{UL,CSP}$, and is set to a closed state otherwise. Therein, in particular, heating and cooling setpoint may be set as dynamic setpoints according to a formula depending on a comfort temperature, where the comfort temperature may be set according to a formula depending on a running mean outside temperature $T_{rm}$, such as a seventh day running mean outside temperature. In addition or alternatively, the heating and cooling setpoint may be set as dynamic setpoints according to any of the known standards, for instance ISO 17772, EN 16798, EN 15251 B, or ASAHRAE. This is exemplarily set out in the following table, where $T_{UL,CSP}$ denotes the cooling setpoint, $T_{LL,HSP}$ denotes the heating setpoint, and $T_{rm}$ denotes the determined outdoor Temperature $T_{int}$ as outdoor running mean temperature as determined outdoor air temperature. For instance, according to the ASAHRAE standard, the comfort temperature is defined as 0.31 $T_{rm}$+17.8° C.

| Standard | Categories | $T_{UL,\ CSP}$ (° C.) | $T_{LL,\ HSP}$ (° C.) | $T_{rm}$ (° C.), applicability range |
|---|---|---|---|---|
| ISO 17772, EN 16798 | I | 0.33*$T_{rm}$ + 18.8 + 2 | 0.33* $T_{rm}$ + 18.8 − 3 | 10-30 |
| | II | 0.33* $T_{rm}$ + 18.8 + 3 | 0.33* $T_{rm}$ + 18.8 − 4 | 10-30 |
| | III | 0.33* $T_{rm}$ + 18.8 + 4 | 0.33* $T_{rm}$ + 18.8 − 5 | 10-30 |
| EN 15751[b] | I | 0.33* $T_{rm}$ + 18.8 + 2 | 0.33* $T_{rm}$ + 18.8 − 2 | 10-30 |
| | II | 0.33* $T_{rm}$ + 18.8 + 3 | 0.33* $T_{rm}$ + 18.8 − 3 | 10-30 |
| | III | 0.33* $T_{rm}$ + 18.8 + 4 | 0.33* $T_{rm}$ + 18.8 − 4 | 10-30 |
| ASHRAE | 80% Acceptability | 0.33* $T_{rm}$ + 21.3 | 0.31* $T_{rm}$ + 14.3 | 10-33.5 |
| | 90% Acceptability | 0.31* $T_{rm}$ + 20.3 | 0.31* $T_{rm}$ + 14.3 | 10-33.5 |

The outdoor running mean temperature may be defined, for instance, by $$T_{rm} = \frac{t_{ed-1} + 0.8 * t_{ed-2} + 0.6 * t_{ed-3} + 0.5 t_{ed-4} + 0.4 * t_{ed-5} + 0.3 * t_{ed-6} + 0.2 * t_{ed-7}}{3.8}$$

There, $t_{ed-1}$ denotes the mean daily outdoor temperature for the previous day, and so forth. The dynamic setpoints ideally vary for every day and thus can be optimized for every climate throughout the year.

This gives the advantage of a dynamic system that adapts on a global scale to the climate of the environment of the building and on a local scale according to the determined indoor temperature as a feedback information. Thus, in a simple way, energy savings and thermal comfort are ensured.

In particular, the state of at least one of a window (or a set of windows), a damper (or a set of dampers), a vent (or a set of vents) or a grid (or a set of grids) may be controlled as state of the at least passive-ventilation device. In other words, the passive-ventilation device may be or comprise at least one of a window (or a set of windows), a damper (or a set of dampers), a vent (or a set of vents) or a grid (or a set of grids). So, the proposed method may be applied to the known passive-ventilation devices easily, as a corresponding state of said passive-ventilation devices or sets of passive-ventilation devices may be defined as closed, open, or intermediate according the above provided definition.

An intermediate state of a set of passive-ventilation device may correspond to a combination of open and closed states of the devices of the set. For instance, a set of two windows may be set to a 50% open state by opening one of the windows and closing the other one. This gives the advantage that simpler control modes of the individual windows suffice for implementing the described control scheme.

In a particularly advantageous embodiment, it is determined whether the at least one zone the passive-ventilation device of which is to be controlled is occupied or not, and/or to be occupied or not at a given time in the future, and the state of said at least one passive-ventilation device is only controlled via setting the opening fraction value if the respective zone is occupied and/or to be occupied at a given time within a preset lapse of time, and set to a closed state otherwise. The preset lapse of time may be set, for instance, to comprise several hours, such as for instance two hours or one hour or only half an hour or a quarter of an hour. This gives the advantage of increased safety, as it is prevented to open the respective passive-ventilation device or devices when nobody is present. Furthermore, if a zone is not occupied or not to be occupied, the priority for ventilation is relatively low, which is reflected in the control scheme.

In another advantageous embodiment, it is determined whether, according to prediction, for instance achieved from the internet or another service, the outdoor air temperature of an air in the environment of the building will be above an upper outdoor temperature limit in the future within a preset lapse of time or not, and, if it is (in particular only if it is), set the state of the at least one passive-ventilation device to a state corresponding to an opening fraction value higher than that of a state of the at least one passive-ventilation device corresponding to the outdoor temperature determined for a present time or lower than that of a state of the at least one passive-ventilation device corresponding to the outdoor temperature for the present time. This gives the advantage, in case of setting the state corresponding to a higher opening fraction that the zone in the building can be pre-cooled, or, alternatively, in case of setting the state corresponding to a lower opening fraction value to lock cool air inside and hence reduce the hours of the use of the mechanical systems. In particular, the state of the at least passive-ventilation device can also be set to the higher opening fraction value in a first time period, and to a lower opening fraction value in a second time period, which is subsequent to the first time period. This combines said advantages.

In another advantageous embodiment, the lower fraction limit l is set to a value greater than zero if a preset criterion is met, and to zero if said criterion is not met. The criterion preferably comprises that the at least one zone corresponding to the controlled passive-ventilation device is occupied or to be occupied, according to a preset schedule. So, a minimal ventilation can be ensured if the zone is to be used or is to be used by people.

In a particular advantageous embodiment, the passive-ventilation function is a linear function f of the calculated temperature difference ΔT. This gives the advantage of a particular simple system that nevertheless solves the objective technical problem at hand very well.

In particular, the linear function is proportional to the difference obtained by subtracting the upper temperature difference limit m from the calculated temperature difference ΔT, preferably proportional to or equal to said difference divided by the difference obtained by subtracting the upper temperature limit m from the lower temperature difference limit k, i.e. f prop. (ΔT−m)/(k−m). This specific linear function is particularly advantageous.

In an alternative embodiment, the passive-ventilation function f is a function proportional to the inverse square root of the product of a variable a1 with the calculated temperature difference ΔT or proportional to the inverse square root of the sum of another variable a0 with the product of the first variable a1 which is a calculated temperature difference ΔT. Therein, the passive-ventilation function is limited to a maximum value of 1 or equivalent, meaning that values of the passive-ventilation function f are set to 1 if the respective expression would actually result in a value bigger than 1. This gives the advantage to account for further limitations or characteristics of a specific setting and provides advantages as the above described linear function.

In particular, the variables a0 and a1 may be derived from a desired total airflow $m_t$ through the at least one passive-ventilation device. In particular, the total airflow $m_t$ is given by $m_t^2=m_b^2+m_b^2$, with $m_b$ being the airflow due to buoyancy and $m_w$ being the airflow due to wind.

Referring to CIBSE guide B, heating, ventilation, air conditioning and fluctuation, London, UK, 2005, the total airflow required for a comfortable environment may be calculated based on the formula for an internal total heat gain $Q_g$ that may be given as $$Q_g=m_t*C_P*(T_{int}-T_{UL,CSP}).$$

Therein, $Q_g$ is the total heat gains in watt, which is determined by the machinery running in the ventilated space, the number of persons present therein, solar irradiation and alike. $C_p$ is the specific heat capacity of air in kJ/(kg*K), $T_{int}$ is the determined internal temperature in ° C., which may be averaged, and $T_{UL,CSP}$ is the cooling setpoint in ° C. With $$m_b=C_d*A_w*[(2*\Delta T*h*g)/(T_{av}+273)]^2,$$

$$m_w=0.05*A_w*V_r, \text{ and}$$

$$m_t^2=m_b^2+m_w^2,$$

a concrete passive-ventilation function may be provided. Therein, the airflows m are given in $m^3$/sec, $A_w$ is the effective area of the windows in square meters, h is the vertical distance between centres of openings of different passive-ventilation devices of the respective zone (which is zero if only one passive-ventilation device is present) in m, g is the acceleration due to gravity in $m/s^2$, and $T_{av}$ is the average value of the determined outdoor and indoor temperature in ° C., and $V_r$ is a wind speed in the environment of the building in m/s.

Consequently, the effective area $A_w$ of the windows can be calculated to be $$A_w=m_t/\{0.05^2*V_r^2+C_d^2*[2*\Delta T*h*g/(T_{av}+273°\text{ C.})]\}^{1/2} \quad \text{(Eq. A)}$$

Therein, $Q_g$ and/or $C_d$ may be preset or calculated according to a specific knowledge or assumption on the respective zone. The discharge coefficient $C_d$ is a dimensionless number used to account for the constriction of stream lines after flow paths through the orifice, that is, through the thermal zone to be ventilated. Therefore, the discharge coefficient is a function of the shape of the opening of the respective passive-ventilation device. The greatest ratio of cross-sectional area to perimeter length occurs with a circular opening, and hence, as opening shapes become less circular, the discharge coefficient decreases. The discharge coefficient of a standard circular sharp-edged orifice $C_d$ is frequently given as 0.61. Compare Jones et al. "A review of ventilation opening area terminology" in: "Energy and Buildings" 118 (2016) 249 to 258. For a single side ventilation, typical values that can be found in the literature are 0.25, while for cross-ventilation $C_d$ ranges from 0.26 to 0.9. Compare "Ventilation of buildings", $2^{nd}$ edition, by Awbi H B, 2003, or the application manual by CIBSE, 2005: "Natural ventilation in non-domestic buildings" as well as the CIBSE Guide A: "Environmental design" 2015. It has been shown that for windows' areas from 0.5 to 0.6 $m^2$, the discharge coefficient can vary from 0.6 to 0.8, while for smaller windows areas, the discharge coefficient tends to larger values from 0.8 to 1.0. For dampers, the discharge coefficient usually ranges from 0.4 to 0.6, depending on the louvre's geometric properties such as the shape and angle of the metallic louvre. For a typical rainproof louvres with the angle of 45°, the discharge coefficient may range from 0.3 to 0.5. Compare Heiselberg P and Sandberg M, "Evaluation of Discharge Coefficients for Window Openings and Wind Driven Natural Ventilation" in: International Journal of Ventilation, ISSN 5(1), 2006, 1473 to 3315.

Correspondingly, the passive-ventilation opening fraction value (and thus the state of passive-ventilation device which best realizes the ideal effective area) is given by (Eq. A) divided by $A_m$, which is a preset maximum openable geometrical area of the respective at least one passive-ventilation device of the passive-ventilation system. So the opening fraction value is $A_w$ divided by $A_m$ for values of $A_w$ less than $A_{max}$, and 1 if $A_w$ is greater or equal to $A_{max}$.

This gives the advantage that the passive-ventilation system is controlled not only based on the temperature difference, but it is accounted for density differences of outside and inside air and the specific setup of the premises to optimize the total flow through the space to be ventilated.

Preferably, the wind speed $V_r$ may be determined by a measurement of a wind sensor of the passive-ventilation system and/or the heat gain $Q_g$ is set or calculated in dependence upon a determination result of whether the at least one zone is occupied or not and/or to be occupied at a given time in the future, in particular by how many persons. This may be determined by a corresponding occupancy sensor or by an occupation schedule for the at least one zone. This further contributes to the advantages described above, namely the saving of energy while providing a comfortably ventilated space in a building.

According to the proposed method, natural ventilation in the buildings may be achieved with respect to specific setpoint temperatures and the selection of the (effective) opening area, that is, the state, of respective passive-ventilation devices of the passive-ventilation system based on given environmental conditions such as outdoor and indoor air temperature. But also wind, outdoor and indoor relative humidity, pollen level, and the like may be taken into account.

For instance, it may be checked whether natural ventilation is suitable to improve the indoor comfort by checking respective criteria such as wind, outdoor and indoor relative humidity, pollen level, and the like. For example, in an initial step it may be checked whether the pollen level in the environment is below a given threshold for well-being and/or the wind level in the environment is below a given threshold for well-being inside the building and/or whether outdoor and/or indoor relative humidity is in a preset acceptability range or not. The proposed method may then be adapted such that the passive ventilation is only enabled if passive ventilation fosters the well-being inside the building, i.e. if the criteria lie beneath the respective thresholds and/or in the respective acceptability ranges. As for humidity levels, the acceptability range may be set as 30%-70% relative humidity (compare Berglund, G. (1998) 'Comfort and Humidity', ASHRAE Transactions, pp. 35-41; Arens, E. A., Xu, T., Bauman, F. and Oguro, M. (1999) 'An investigation of thermal comfort at high humidity', ASHRAE Transactions, 105(2), pp. 94-103; ASHRAE-Standard-55 (2013) Thermal Environmental Conditions for human occupancy, Atlanta, USA).

The control algorithm can utilize historic weather data to calculate dynamic setpoints for natural ventilation, and uses an analytic formula, which may even be linear, to calculate the optimum position of the passive-ventilation devices based on outdoor and indoor air temperature in particular also pressure differences reflected in airflow due to buoyancy and/or due to wind forces between inside and outside. Also prediction data fora range of optional parameters such as weather, number of occupants, preferred temperature settings and alike, may be included to allow for improved specificity regarding appropriate configurations and control of the passive-ventilation devices.

The control method may be implemented in any existing building management system. Sensors for the outdoor and indoor environmental conditions could and should be used to provide the required inputs to the controller of the passive-ventilation system, in addition to sensors providing information about the state of the respective passive-ventilation devices, and potentially also an information about an operational mode, for instance if the building is to be cooled by the passive natural ventilation mode or by an active mechanical mode. If the mechanical mode is activated, the controller of the passive-ventilation system may be passive/paused and let the established system control the heating and/or cooling.

Another aspect relates to a passive-ventilation system with a control device configured to perform the method or any of the embodiments described above. A further aspect relates to a building with such a passive-ventilation system.

Advantages and advantageous embodiments of the passive-ventilation system and the building correspond to advantages and advantageous embodiment of the described method.

The features and combinations of features described above, including the general part of the description, as well as the features and combinations of features disclosed in the FIGURE description or the figures alone may not only be used alone or in the described combination, but also with other features or without some of the disclosed features without leaving the scope of the invention. Consequently, embodiments that are not explicitly shown and described by the figures but that can be generated by separately combining the individual features disclosed in the figures are also part of the invention. Therefore, embodiments and combinations of features that do not comprise all features of an originally formulated independent claim are to be regarded as disclosed. Furthermore, embodiments and combinations of features that differ from or extend beyond the combinations of features described by the dependencies of the claims are to be regarded as disclosed.

Exemplary embodiments are further described in the following by means of schematic drawings. Therein, FIG. 1 shows an exemplary flow chart for one embodiment of a method for controlling a passive-ventilation system of a building.

Therein, in a first step S1, it is determined whether heating is unnecessary or not. In the present example, this is achieved by checking if both the indoor air temperature $T_{int}$, which may be an averaged temperature, and an outdoor air temperature $T_{out}$, which may be an averaged temperature, is greater than a heating setpoint $T_{LL,HSP}$ (in the present case plus a certain preset dead band temperature DB). If this is not the case, which means that it is cold and heating is required, it is checked whether the indoor air temperature is less than the heating setpoint $T_{LL,HSP}$ (plus said dead band temperature DB) in step S11. If this is the case, in step S12, the windows are closed and conventional mechanical heating is switched on. If step S11 gives "no" as a result, in step Sx, the windows are closed and heating/cooling is not switched on.

If the result of step S1 is "yes", that means, that mechanical heating is not required, in step S2 it is checked if both the indoor air temperature $T_{int}$ and the outside air temperature $T_{out}$ is below a cooling setpoint $T_{UL,CSP}$ (in the present case minus said preset temperature DB). If the result of step S2 is "no", that is, a cooling is potentially required, in step S21 it is checked whether the indoor air temperature $T_{int}$ is above the cooling setpoint $T_{UL,CSP}$ (plus said dead band temperature DB here). If this is not the case, it is proceeded with step Sx. If this is the case, in step S22, the windows are closed and a conventional mechanical cooling is started.

If step S2 gives "yes" as a result, which means that no mechanical cooling is required, it is checked in a step S3 whether a passive-ventilation device such as a window is open or not. If the result of step S3 is "yes", the passive-ventilation device or devices are, in this example, held in the present state in step Sy, and the process starts again.

If step S3 gives "no" as a result, in Step S4 a state of at least one passive-ventilation device of the passive-ventilation system is controlled via setting an opening fraction value OF, where the opening fraction value OF varies between 0 and 1, and corresponds to a respective state of the corresponding passive-ventilation device of at least one zone inside the building to be ventilated. The state may be any of a closed state, an open state, one of one or more intermediate states between closed and open state, where an opening fraction value of 0 corresponds to the closed state, an opening fraction value of 1 corresponds to the open state, and opening fraction values in between 0 and 1 are associated with the one or more intermediate state.

If the calculated temperature difference of $\Delta T=T_{int}-T_{out}$ is equal to or below a preset lower temperature difference limit k, the opening fraction value is set to 1. If the calculated temperature difference ΔT is equal or above a preset upper temperature difference limit m, the opening fraction value is set to a lower fraction limit l, which is equal to or greater than 0 and less than 1, and greater 0 in the example at hand. Otherwise, that is, the calculated temperature difference being below the preset upper temperature difference limit m and above the preset lower temperature difference limit k, the opening fraction value is that of a passive-ventilation function of the calculated temperature difference ΔT. This passive-ventilation function is monotonically decreasing with increasing calculating temperature difference ΔT, in the present example the linear function $f(\Delta T)=(\Delta T-m)/(k-m)$.

By the presented control scheme, an energy efficient and thermally comfortable ventilation of the building is achieved.

The invention claimed is:

1. A method for controlling a passive-ventilation system of a building, comprising:

determining an outdoor air temperature ($T_{out}$) of air in an environment of the building;

determining an indoor air temperature ($T_{int}$) of at least one zone inside the building;

calculating a temperature difference (ΔT) by subtracting the determined outside air temperature ($T_{out}$) from the determined indoor air temperature ($T_{int}$);

under condition that the calculated temperature difference (ΔT) is greater than zero, controlling a state of at least one passive-ventilation device of the passive-ventilation system to be in any of: a closed state, an open state, or one of one or more intermediate states between the closed state and the open state, where each of the intermediate states corresponds to one value of an opening fraction value (OF) of the at least one zone inside the building varying between 0 and 1, where 0 corresponds to the closed state and 1 corresponds to the open state, and where the at least one passive-ventilation device is configured for a fluidic coupling of at least one respective zone of the at least one zone inside the building with the environment of the building; and determining, according to a prediction, whether or not the outdoor air temperature ($T_{out}$) of the air in the environment of the building will be above an upper outdoor temperature limit in the future within a pre-set lapse of time, and, under condition that the outdoor air temperature ($T_{out}$) of the air in the environment of the building will be above the upper outdoor temperature limit in the future within the pre-set lapse of time, the state of the at least one passive-ventilation device is set to a state corresponding to the opening fraction value (OF) higher than that of a state of the at least one passive-ventilation device corresponding to the outdoor temperature determined for a present time or lower than that of the state of the at least one passive-ventilation device corresponding to the outdoor temperature determined for the present time, wherein the state of the at least one passive-ventilation device is controlled via setting the opening fraction value (OF), the opening fraction value (OF) being set to:

an upper fraction limit equal to 1, under condition where the calculated temperature difference (ΔT) is equal to or below a pre-set lower temperature difference limit (k);

a lower fraction limit (I) equal to or greater than 0 and less than 1, under condition where the calculated temperature difference (ΔT) is equal to or above a pre-set upper temperature difference limit (m); and a value of a passive-ventilation function of the calculated temperature difference (ΔT) otherwise, the passive-ventilation function monotonically decreasing with increasing calculated temperature difference (ΔT).

2. The method of claim 1, wherein the state of the at least one passive-ventilation device is only controlled via setting the opening fraction value (OF) if both the determined outdoor air temperature ($T_{out}$) and the determined indoor air temperature ($T_{int}$) lie in a range between a lower set point and an upper set point, and is set to the closed state otherwise, where the lower set point and the upper set point are settable as dynamic set points according to a formula depending on a comfort temperature, where the comfort temperature is settable according to another formula depending on a running mean outside temperature, and the lower set point is a heating set point ($T_{LL,HSP}$) and the upper set point is a cooling set point ($T_{UL,CSP}$).

3. The method of claim 2, wherein the passive-ventilation function is a function proportional to {1/sqrt[a1*ΔT]} or proportional to {1/sqrt[a0+a1*ΔT]}, where a0 and a1 are variables, and wherein the passive-ventilation function is limited to a maximum value of 1.

4. The method of claim 3, wherein the variables a0 and a1 are derived from a desired total airflow $m_t$ ($m_t$) through the at least one passive-ventilation device, where the total airflow $m_t$ is given by $m_t^2=m_b^2+m_w^2$, with my being airflow due to buoyancy ($m_b$) and $m_w$ airflow due to wind ($m_w$).

5. The method of claim 3, wherein the passive-ventilation function is given by or proportional to $[Q_g/\{C_P*[T_{int}-T_{UL,CSP}]*sqrt[0,05^2*V_r^2+Cd^2*\{[2*AT*h*g]/[T_{av}+273° C.]\}]\}/A_m]$, where $Q_g$ is a pre-set total heat gain, $C_P$ the specific heat capacity of air, $T_{int}$ the determined in-door temperature, $T_{UL,CSP}$ the cooling set point, $V_r$ a wind speed in the environment of the building, $C_d$ a pre-set discharge coefficient, h a pre-set vertical distance between centres of openings of different passive-ventilation devices, g the acceleration due to gravity, $T_{av}$ the average value of the determined in-door and the outdoor air temperature ($T_{int}$, $T_{out}$), and $A_m$ a pre-set maximum openable geometrical area of the at least one passive-ventilation device of the passive-ventilation system.

6. The method of claim 5, wherein the wind speed $V_r$ is determined by a measurement of a wind sensor of the passive-ventilation system and/or the pre-set total heat gain $Q_g$ is set or calculated in dependence upon a determination result of whether the at least one zone is occupied or not and/or to be occupied at a given time in the future, including by how many persons.

7. The method of claim 1, wherein a state of at least one of: a window, a damper, a vent is controlled as state of the at least one passive-ventilation device.

8. The method of claim 1, further comprising determining whether the at least one zone is occupied or not, and/or to be occupied at a given time in the future, and the state of the at least one passive-ventilation device is only controlled via setting the opening fraction value (OF) under condition where the respective zone is determined to be occupied and/or to be occupied at the given time which is within the pre-set lapse of time, and set to the closed state otherwise.

9. The method of claim 1, further comprising setting the lower fraction limit (I) to a value greater than 0 under condition where a pre-set criterion is met and to 0 under condition where said pre-set criterion is not met, where the pre-set criterion includes that the at least one zone is occupied.

10. The method of claim 1, wherein the passive-ventilation function is a linear function of the calculated temperature difference (ΔT).

11. The method of claim 10, wherein the linear function is proportional to [ΔT−m], ΔT being the calculated temperature difference (ΔT) and m being the pre-set upper temperature difference limit (m), and proportional or equal to [ΔT−m]/[k−m], where k is the pre-set lower temperature difference limit (k).

12. A passive-ventilation system with a control device configured to perform the method of claim 1.

13. A building with a passive-ventilation system of claim 12.

14. A method for controlling a passive-ventilation system of a building, comprising:

determining an outdoor air temperature ($T_{out}$) of air in an environment of the building;

determining an indoor air temperature ($T_{int}$) of at least one zone inside the building;

calculating a temperature difference (ΔT) by subtracting the determined outside air temperature ($T_{out}$) from the determined indoor air temperature ($T_{int}$);

under condition that the calculated temperature difference (ΔT) is greater than zero, controlling a state of at least one passive-ventilation device of the passive-ventilation system to be in any of: a closed state, an open state, or one of one or more intermediate states between the closed state and the open state, where each of the intermediate states corresponds to one value of an opening fraction value (OF) of the at least one zone inside the building varying between 0 and 1, where 0 corresponds to the closed state and 1 corresponds to the open state, and where the at least one passive-ventilation device is configured for a fluidic coupling of at least one respective zone of the at least one zone inside the building with the environment of the building;

wherein the state of the at least one passive-ventilation device is controlled via setting the opening fraction value (OF), the opening fraction value (OF) being set to:

an upper fraction limit equal to 1, under condition where the calculated temperature difference (ΔT) is equal to or below a pre-set lower temperature difference limit (k);

a lower fraction limit (I) equal to or greater than 0 and less than 1, under condition where the calculated temperature difference (ΔT) is equal to or above a pre-set upper temperature difference limit (m); and a value of a passive-ventilation function of the calculated temperature difference (ΔT) otherwise, the passive-ventilation function monotonically decreasing with increasing calculated temperature difference (ΔT), the state of the at least one passive-ventilation device is only controlled via setting the opening fraction value (OF) if both the determined outdoor air temperature ($T_{out}$) and the determined indoor air temperature ($T_{int}$) lie in a range between a lower set point and an upper set point, and is set to the closed state otherwise, where the lower set point and the upper set point are settable as dynamic set points according to a formula depending on a comfort temperature, where the comfort temperature is settable according to another formula depending on a running mean outside temperature, and the lower set point is a heating set point ($T_{LL,HSP}$) and the upper set point is a cooling set point ($T_{UL,CSP}$).

15. A method for controlling a passive-ventilation system of a building, comprising:

determining an outdoor air temperature ($T_{out}$) of air in an environment of the building;

determining an indoor air temperature ($T_{int}$) of at least one zone inside the building;

calculating a temperature difference (ΔT) by subtracting the determined outside air temperature ($T_{out}$) from the determined indoor air temperature ($T_{int}$);

under condition that the calculated temperature difference (ΔT) is greater than zero, controlling a state of at least one passive-ventilation device of the passive-ventilation system to be in any of: a closed state, an open state, or one of one or more intermediate states between the closed state and the open state, where each of the intermediate states corresponds to one value of an opening fraction value (OF) of the at least one zone inside the building varying between 0 and 1, where 0 corresponds to the closed state and 1 corresponds to the open state, and where the at least one passive-ventilation device is configured for a fluidic coupling of at least one respective zone of the at least one zone inside the building with the environment of the building;

wherein the state of the at least one passive-ventilation device is controlled via setting the opening fraction value (OF), the opening fraction value (OF) being set to:

an upper fraction limit equal to 1, under condition where the calculated temperature difference (ΔT) is equal to or below a pre-set lower temperature difference limit (k);

a lower fraction limit (I) equal to or greater than 0 and less than 1, under condition where the calculated temperature difference (ΔT) is equal to or above a pre-set upper temperature difference limit (m); and a value of a passive-ventilation function of the calculated temperature difference (ΔT) otherwise, the passive-ventilation function monotonically decreasing with increasing calculated temperature difference ($\Delta T$), and the passive-ventilation function is a function proportional to $\{1/\mathrm{sqrt}[a1*\Delta T]\}$ or proportional to $\{1/\mathrm{sqrt}[a0+a1*\Delta T]\}$, where a0 and a1 are variables, and wherein the passive-ventilation function is limited to a maximum value of 1.

* * * * *